US011926928B2

(12) United States Patent
Solberg

(10) Patent No.: US 11,926,928 B2
(45) Date of Patent: Mar. 12, 2024

(54) ELECTROSPINNING METHOD AND APPARATUS

(71) Applicant: Innovative Mechanical Engineering Technologies B.V., Waalre (NL)

(72) Inventor: Ramon Hubertus Mathijs Solberg, Munstergeleen (NL)

(73) Assignee: Innovative Mechanical Engineering Technologies B.V., Waalre (NL)

( * ) Notice: Subject to any disclaimer, the term of this patent is extended or adjusted under 35 U.S.C. 154(b) by 229 days.

(21) Appl. No.: 17/277,739

(22) PCT Filed: Sep. 20, 2019

(86) PCT No.: PCT/NL2019/050631
§ 371 (c)(1),
(2) Date: Mar. 19, 2021

(87) PCT Pub. No.: WO2020/060411
PCT Pub. Date: Mar. 26, 2020

(65) Prior Publication Data

US 2022/0112626 A1 Apr. 14, 2022

(30) Foreign Application Priority Data

Sep. 21, 2018 (NL) ..... 2021681

(51) Int. Cl.
*D01D 1/09* (2006.01)
*D01D 5/00* (2006.01)

(52) U.S. Cl.
CPC ..... *D01D 1/09* (2013.01); *D01D 5/0069* (2013.01)

(58) Field of Classification Search
CPC ..... D01D 5/0069; D01D 1/09
See application file for complete search history.

(56) References Cited

U.S. PATENT DOCUMENTS 4,708,619 A * 11/1987 Balk ..... D01D 1/09 348/331
4,797,079 A * 1/1989 Balk ..... D01D 1/09 425/467

(Continued)

FOREIGN PATENT DOCUMENTS

CN 103465628 A 12/2013
CN 105839202 A 8/2016

(Continued)

OTHER PUBLICATIONS

Smeets et al., "Electrospraying of polymer solutions: Study of formulation and process parameters", European Journal of Pharmaceutics and Biopharmaceutics 119 (2017), p. 114-124.

(Continued)

*Primary Examiner* — Emmanuel S Luk
(74) *Attorney, Agent, or Firm* — N.V. Nederlandsch Octrooibureau

(57) ABSTRACT

Electrospinning apparatus and method for electrospinning of material by ejecting spinning material from a nozzle outlet. The electrospinning apparatus includes a spinning material supply unit, a nozzle unit with a nozzle outlet, a collector unit for collecting a fibre formed during operation of the electrospinning apparatus and a voltage supply unit for applying a voltage difference between the nozzle unit and collector unit. An imaging device is present for capturing an image of a conus and the fibre being formed during operation, as well as a processing unit connected to the imaging device, spinning material supply unit and voltage supply unit. The processing unit is arranged to determine a shape of the conus, and control operation of the electrospinning apparatus based on the determined shape of the conus.

17 Claims, 2 Drawing Sheets

(56) References Cited

U.S. PATENT DOCUMENTS

Figure 1:
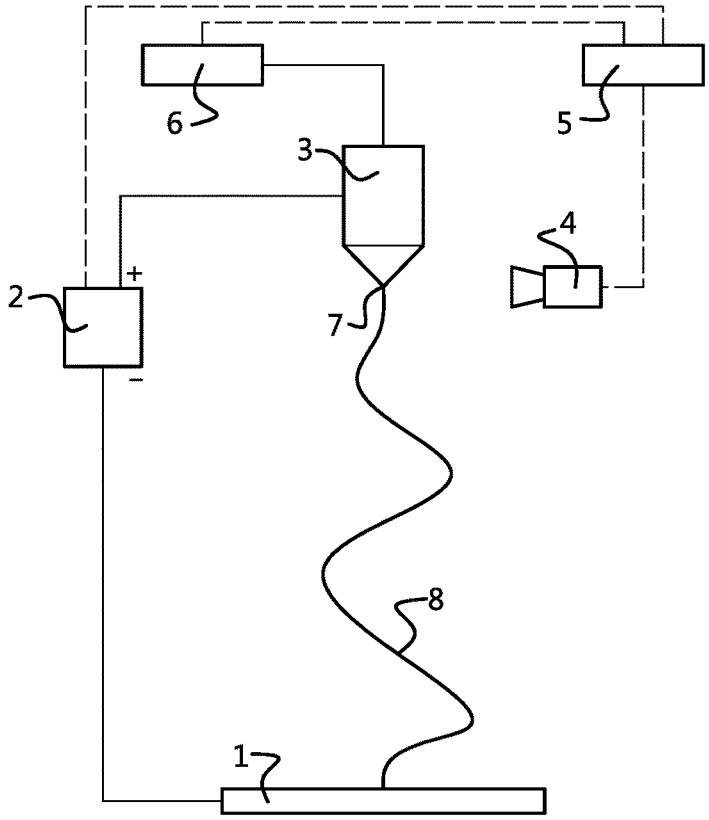

| | | | | |
|---|---|---|---|---|
| 10,085,829 | B2 * | 10/2018 | Soletti | D01D 5/0084 |
| 2015/0073551 | A1 * | 3/2015 | Uehlin | A61L 27/3834 623/13.12 |
| 2016/0325480 | A1 * | 11/2016 | Soletti | A61F 2/06 |

FOREIGN PATENT DOCUMENTS

| | | | |
|---|---|---|---|
| CN | 104309338 | B | 1/2017 |
| CN | 107932894 | A | 4/2018 |
| KR | 100836274 | B1 | 6/2008 |
| KR | 101622054 | B1 | 5/2016 |
| KR | 10-2016-0081520 | A | 7/2016 |

OTHER PUBLICATIONS

Yang et al., "Feedback System Control Optimized Electrospinning for Fabrication of an Excellent Superhydrophobic Surface", Nanomaterials 2017, 7, 319; doi:10.3390/nano7100319, www.mdpi.com/journal/nanomaterials.

Svoboda et al., "Apparatus for Feedback Control of Electrospinning Process", 2014.

Samatham et al., "Electric Current as a Control Variable in the Electrospinning Process", Polymer Engineering and Science 2006, p. 954-959, DOI 10.1002/pen.

Warner et al., "A Fundamental Investigation of the Formation and Properties of Electrospun Fibers", National Textile Center Annual Report: Nov. 1999, M98-D01, p. 1-10.

* cited by examiner

ELECTROSPINNING METHOD AND APPARATUS

FIELD OF THE INVENTION

The present invention relates to a method for electrospinning of material by ejecting spinning material from a nozzle outlet of an electrospinning apparatus, the nozzle outlet having an outer diameter. In addition, the present invention relates to an electrospinning apparatus comprising a spinning material supply unit; a nozzle unit in communication with the spinning material supply unit having a nozzle outlet; a collector unit for collecting a fibre formed during operation of the electrospinning apparatus; and a voltage supply unit for applying a voltage difference between the nozzle unit and collector unit.

BACKGROUND ART

International patent publication WO2017/182560 describes an electrospinning device and method. A liquid comprising a polymer melt or polymer solution is fed to a nozzle, and by applying an electrical field between the nozzle and a target electrode, a very thin and continuous fibre will form, which can be used to e.g. form a fibrous structure. In this publication an optical measurement system is provided arranged to measure the thickness of the fibrous structure being formed.

Chinese patent publication CN-A-104309338 discloses a closed-loop control method for electrospining direct writing technology. According to the fluid change at actual spraying time, the liquid at the nozzle is divided into Taylor cone and jet flow for control. A high speed camera is used for detecting the form, and the information is directly fed back to the controller for adjusting and controlling the substrate movement speed and spraying voltage impacting the jet flow and Taylor cone.

US patent publication US2016/325480 discloses a self-diagnostic graft production system for producing a graft device. A polymer delivery assembly is provided for delivering a fiber matrix of a spun polymer material.

Chinese patent publication CN-A-105839202 discloses a method for controlling diameter and structure of electrospun polyacrylonitrile fibers. In the electrospinning process of polyacrylonitrile, through reduction of the size of a Taylor cone, the diameter of the prepared electrospun polyacrylonitrile fibers can be reduced and the fiber structure of the electrospun polyacrylonitrile fibers can be improved. The diameter and the structure of the prepared fibers can be controlled in real time by observing the Taylor cone in real time.

SUMMARY OF THE INVENTION

The present invention seeks to provide an improved electrospinning method and apparatus, allowing reproducible formation of the spun fibre and fibrous structures.

According to a first aspect of the present invention, a method as defined above is provided, the method comprising determining a shape of a conus of fluid spinning material exiting the nozzle outlet from an image captured during operational use of the electrospinning apparatus, wherein determining a shape of the conus comprises a calibration of the captured image using predetermined dimensions of a reference part of the electrospinning apparatus (such as the nozzle outlet) and edge detection in the captured image, and controlling operating parameters of the electrospinning apparatus based on a difference between the determined shape of the conus and a desired shape of the conus. In a further group of embodiments, the method further comprises determining from the shape of the conus a spin wire diameter determination area in the captured image, determining an actual spin wire diameter at the spin wire diameter determination area, and controlling operating parameters of the electrospinning apparatus based on a difference between the actual spin wire diameter and a desired spin wire diameter.

According to a second aspect of the present invention, an electrospinning apparatus as defined above is provided, further comprising an imaging device for capturing an image of a conus and the fibre being formed during operation and a processing unit connected to the imaging device, spinning material supply unit and voltage supply unit, wherein the processing unit is arranged to determine a shape of the conus by a calibration of the captured image using predetermined dimensions of a reference part of the electrospinning apparatus and edge detection in the captured image, and control operation of the electrospinning apparatus based on the determined shape of the conus.

The invention embodiments described herein can be used to enhance fibre reproducibility for general electrospinning processes, and also to allow quality control on fibre morphology of the fibrous structures formed.

SHORT DESCRIPTION OF DRAWINGS

Figure 2:
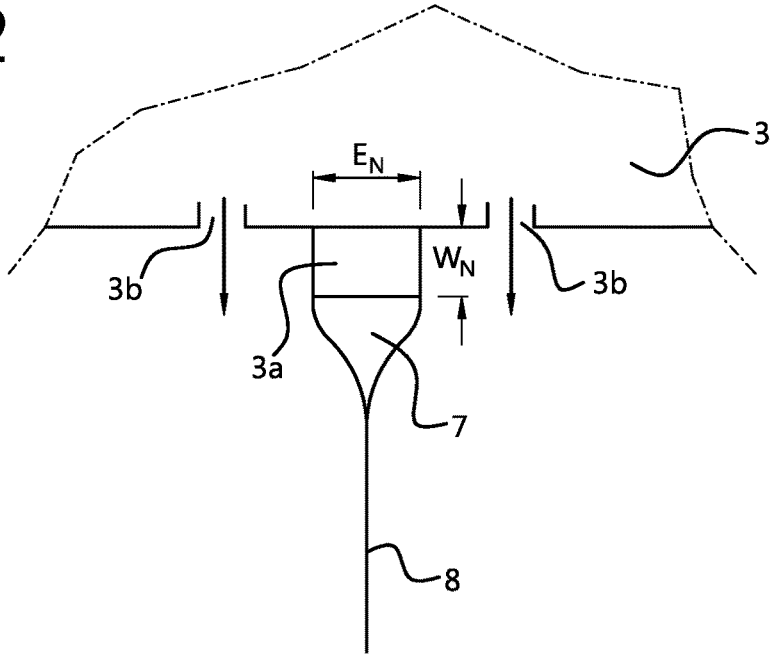

The present invention will be discussed in more detail below, with reference to the attached drawings, in which FIG. 1 shows a block diagram of an electrospinning apparatus according to an embodiment of the present invention;

FIG. 2 shows a partial cross sectional view of a nozzle area of an embodiment of an electrospinning apparatus according to the present invention; and FIG. 3A-E shows simplified images of various forms of cones being formed during actual operation of the present invention electrospinning apparatus embodiments.

DESCRIPTION OF EMBODIMENTS

The present invention embodiments can be applied in a plurality of applications where electrospinning of a fibre or fibrous material is executed to obtain (semi-)products. The fibrous material can have varying geometry, such as yarned fibres, fibre sheets, fibrous tubes, etc.

In FIG. 1 a generic schematic view is given of an exemplary embodiment of an electrospinning apparatus according to the present invention. At the bottom, a collector unit 1 is present (also acting as a counter electrode) which is arranged to have the fibrous material formed thereon. A (high) voltage supply unit 2 is present, which in operation applies a (high) voltage difference between the collector unit and a nozzle unit 3. The nozzle unit 3 is in communication with a spinning material supply unit 6, and holds an amount of fluid or fluidized spinning material, such as a polymer solution or polymer composition. By applying the high voltage and feeding the nozzle unit 3 with spinning material, a conus (or Taylor cone) 7 is formed at a tip of the nozzle unit 3, as well as a thin fibre 8. Furthermore, in this exemplary embodiment, an imaging device 4 is provided, in contact with a processing unit 5 (which is connected to and can control operating parameters of the spinning material supply unit 6 and voltage supply unit 2.

A partial cross sectional view of a nozzle area of an embodiment of an electrospinning apparatus according to the present invention is shown in FIG. 2, wherein the nozzle unit 3 comprises a nozzle outlet 3*a* (e.g. implemented using a needle or tube like element). The nozzle outlet 3*a* has an outer diameter (or width) $E_N$ and extends over a nozzle protrusion distance $W_N$ from a surface of the nozzle unit 3 into a processing chamber of the electrospinning apparatus. In the embodiment shown, an optionally present gas flow channel 3*b* is shown surrounding the nozzle outlet 3*a*. Depending on the type and amount of gas flowing out of the gas flow channel 3*b* acting as a shield around the conus 7 and fibre 8 being formed, the solidification process of the fibre 8 can be controlled during operation of the electrospinning apparatus.

Electrospinning is a method to produce continuous fibres 8 with a diameter ranging from a few tens of nanometres to a few tens of micrometres. To electrospin fibres 8, a suitable (liquefied) spinning material may be fed through the small nozzle outlet 3*a* of nozzle unit 3. The (liquefied) material may be electrically charged by applying a high voltage between the material in nozzle 3 and the collector unit 1 or counter electrode 1. The generated electric field causes a cone-shape deformation of a droplet 7 at the nozzle outlet or tip 3*a*. Once the surface tension of this droplet is overcome by the electrical force, a jet is formed out of the droplet and a fibre 8 forms that moves towards the collector unit 1. During the flight towards the collector unit 1 the fibre 8 is continuously stretched and elongated by the different forces acting on it, reducing its diameter and allowing it to solidify (e.g. by evaporation of the solvent or cooling of the material) such that a solid fibre 8 is deposited on the collector unit 1. It is noted that the collector unit 1 may comprise a flat plate which is placed just in front of a counter electrode connected to the voltage supply unit 2, as an alternative to the collector unit 1 being connected to the voltage supply unit 2.

The imaging device 4 (e.g. a high resolution camera) is added to the electrospinning apparatus to allow stabilization and/or control of the spinning conus 7 during a (needle-based) electrospinning process by means of smart-vision feedback system implementation.

In generic wording, according to one aspect of the present invention, a method is provided for electrospinning of material by ejecting (fluid or fluidized) spinning material from a nozzle outlet 3*a* of an electrospinning apparatus, the nozzle outlet 3*a* having an outer diameter $E_N$. The method comprises determining a shape of a conus 7 of fluid spinning material exiting the nozzle outlet 3*a* from an image captured during operational use of the electrospinning apparatus (e.g. using video processing, such as edge detection), and controlling operating parameters of the electrospinning apparatus based on a difference between the determined shape of the conus 7 and a desired shape of the conus 7. In a further embodiment, the method comprises a different step of controlling the operating parameters, i.e. by determining from the shape of the conus 7 a spin wire diameter determination area in the captured image, determining an actual spin wire diameter d at the spin wire diameter determination area (using e.g. edge detection techniques), and controlling operating parameters of the electrospinning apparatus based on a difference between the actual spin wire diameter d and a desired spin wire diameter.

It is noted that the technique of electrospinning uses an electric field, generated by a high voltage potential between generically a nozzle and a collector, to produce a fibre 8 from a droplet at the nozzle tip/outlet 3*a*. When an electrospinning process is run for a certain time, the provided spinning material might change in composition (intended or non-intended) and this change has an effect on the morphology and dimensioning of the resulting fibre 8. This change in material can also be seen at the tip of nozzle outlet 3*a* by alterations in the dimensions of the spinning conus 7. By detecting these alterations by the imaging device 4 (e.g. a vision camera) and the processing unit 5 at the tip of nozzle outlet 3*a*, compensations can be applied to the process to keep the fibre alterations under control.

In case spinning materials (mostly polymers) are used that change in composition (due to e.g. temperature, viscosity or solvent evaporation changes) during the time that the spinning process is on-going, the spinning behaviour can be drastically affected which results in a changing fibre morphology or even stops the spinning process in total.

The presently proposed method embodiments use a smart-vision camera (imaging device 4) with e.g. a tailored lens and associated video/image processing software being executed on processing unit 5 to perform real-time measurements on the spinning conus 7. In case the material behaviour changes, this can be detected by the measurements performed. Via a material-specific algorithm the measurement deviations are used as a feedback signal to the spinning process to compensate the deviations that occur. These compensations can be e.g. change in the material flow and/or change in spinning voltage and/or spinning distance. In a further embodiment of the present invention, the operating parameters of the electrospinning apparatus comprise one or more of: a voltage between the nozzle outlet 3*a* and a collector unit 1; an amount of spinning material flowing through the nozzle outlet 3*a*; environmental conditions (e.g. temperature, humidity, . . . ) in a processing chamber of the electrospinning apparatus; environmental conditions of the nozzle unit 3, such as temperature; an amount of gas flowing through a gas flow channel 3*b* surrounding the nozzle outlet 3*a*; a nozzle protrusion distance $W_N$ of the nozzle outlet 3*a* extending into a processing chamber of electrospinning apparatus. In an even further exemplary embodiment, the nozzle outlet 3*a* is provided with an adjustable aperture through which the fluid flows during operation, and the adjustable aperture can be controlled to influence the orifice and thus the shape of the conus 7.

Vision based feedback for compensating material changes (e.g. viscosity) in electrospinning processes can be implemented in a sufficiently fast and robust manner using processing resources of sufficient capacity in the processing unit 5. Different material properties of the spinning material (or spinning solution compositions) and processing parameter settings result in a spinning conus 7 with a specific shape. E.g. for processing nanofibres 8, the conus 7 is relatively concave and thin (see e.g. FIG. 3D), and for microfibres 8 the conus 7 is more convex and wide (see e.g. FIG. 3C). The dimensions of the conus 7 can also be on the edge of producing any stable fibre 8. The conus can be over-convex (see FIG. 3A) or over-concave (see FIG. 3E) or even the cone can be retracted inside the nozzle tip, which mostly results in an unstable material ejection at the tip of nozzle outlet 3*a*.

The shape of the conus 7 during operation of the electrospinning apparatus may be captured using imaging device 4, and processed using image processing techniques implemented in the processing unit 5. By capturing an image including a part of the nozzle unit 3 (and fibre 8), or any other reference part of the electrospinning apparatus, it is possible to e.g. use predetermined (i.e. known) dimensions of the nozzle outlet 3*a* (e.g. nozzle protrusion distance $W_N$ and outer diameter $E_N$) to calibrate the measurements from a captured image. To that end, in a further embodiment, determining a shape of the conus 7 comprises a calibration of the captured image using predetermined dimensions of a reference part of the electrospinning apparatus (such as the nozzle outlet 3*a*) and edge detection in the captured image.

For different products, the fibre dimensions should be as constant as possible overall or the fibres should have certain dimensional or morphological changes over time. Changing the processing settings according to a time-frame (i.e. as function of time) works but does not compensate for unforeseen disturbances in material behaviour. The present invention method embodiments will overcome these problems. By visualizing the spinning conus 7 by a smart-vision camera (imaging device 4) with the ability of performing (real-time) measurements on the captured image of the conus 7, deviations due to material changes can be measured and fed into an algorithm to (real-time) adapt the spinning process. The process can be influenced by e.g. changing the material flow, spinning voltage, spinning distance or the shielding gas flow.

Figure 3A:
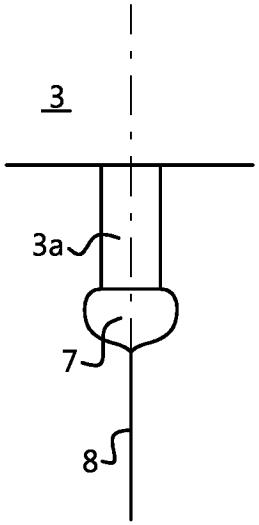
Figure 3B:
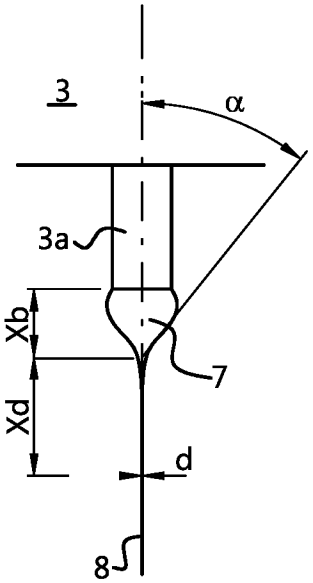

In one method embodiment, determining a shape of a conus 7 comprises (dynamically) determining a base point Xb along a primary axis of the electrospinning apparatus, as shown in the cross sectional view of FIG. 3B. Alternatively, determining a shape of a conus 7 comprises (dynamically) determining a base point Xb along the centreline of the spinning conus 7. The primary axis/centreline can be defined as the line perpendicular to an end surface of the nozzle outlet 3*a*, or as a trajectory of the spinning material of the fibre 8 being formed. This can be implemented in the processing unit 5 using image detection and processing algorithms, e.g. using edge detection and/or pixilation techniques.

Figure 3C:
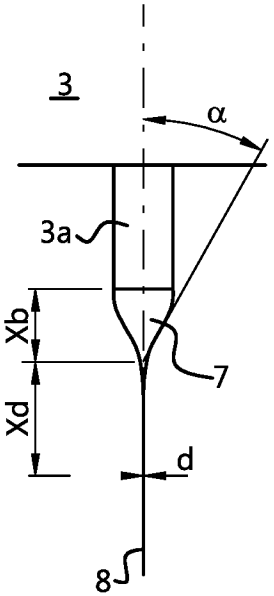
Figure 3D:
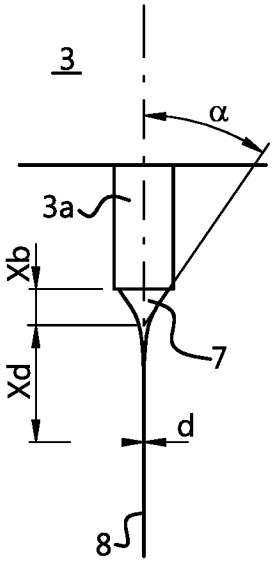
Figure 3E:
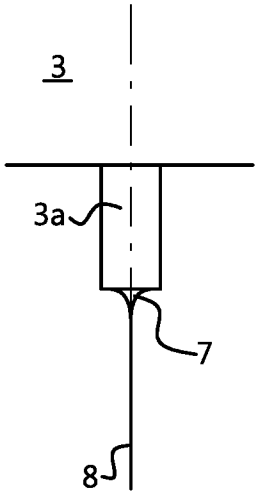

In one specific embodiment, the base point Xb is determined using curve matching of an edge of the conus 7 in the captured image. Curve matching may be applied in the captured image by finding an apex angle $\alpha$ as shown in FIG. 3B-D, e.g. using straight lines (i.e. a best match of a triangular conus from an edge of the nozzle outlet 3*a* with apex angle $\alpha$. Alternatively, curve matching may be applied using $2^{nd}$ or higher order curve matching of a detected edge of the conus 7 in the captured image. In other words, by determining a tip point of the spinning conus 7 and applying a linear (or higher order) fit on the edge of the spinning conus 7, it is possible to determine the angle $\alpha$ of the conus 7 and the intersecting point as base point on the centre axis of the conus 7. This intersecting point then provides the distance Xb from the tip of the nozzle outlet 3*a*.

In a further group of embodiments, the jet diameter d (i.e. the diameter of the fibre 8 being formed during operation) is measured at a fixed distance Xd from the determined tip of the conus (i.e. base point Xb). In relation to the generic method embodiment described above, in a further embodiment the spin wire diameter determination area is determined as a point along the primary axis at a predetermined distance Xd from the base point Xb. The predetermined distance Xd is e.g. dependent on the composition of spinning material. Using a predetermined distance Xd from the base point Xb gives a stable jet diameter measurement that results in reliable material flow information. It is noted that the information of base point Xb in combination with the cone angle $\alpha$ provides information about the shape of the conus 7 and its stability.

In an alternative embodiment, the spin wire diameter determination area is determined as a point along the primary axis at a predetermined factor i times the base point distance from an edge of the nozzle outlet 3*a* in the captured image to the base point Xb. Similar to the previous embodiment, using a factor i to determine where the fibre 8 diameter d is measured, will result in a reliable and relevant measurement. In an exemplary embodiment, i=2.

Next to the basic measurements, more information can be extracted from the image (e.g. nozzle diameter, nozzle protrusion distance, angular displacements of the fibre 8 being formed) that can be advantageous in automating the measurement process between consecutive images and can even provide quality control information. In a further method embodiment, the base point Xb (and/or diameter d of the fibre 8) is measured periodically over time.

In the case that the images are taking from a nozzle unit 3 that moves via a translational movement, taking consecutive images by the imaging device 4, may result in subsequent images wherein the apex of conus 7 may vary a bit in relation to the nozzle outlet 3*a*. By seeking certain markers in the image, such as the edges of the nozzle outlet 3*a*, the (little) distortion can be corrected before making the general measurements. In such a moving nozzle unit 3 embodiments, periodic measurements may also be synchronized to the up and down (translational) movement, e.g. (assuming a fixed position of the imaging device 4) processing an image captured once or twice every up and down cycle.

Via the measurements of one or more embodiments as described above, all deviations of the conus 7 can be determined and used for feedback. Every material and/or product requires a certain conus 7 shape to result in the required fibre 8 morphology. By using (or learning) the required conus 7 shape as a (time dependent) benchmark, all deviations according to this benchmark can be fed into an algorithm that calculates the required changes in process settings.

In a further exemplary embodiment, the method further comprises adjusting the operating parameters of the electrospinning apparatus upon detection of a change of the shape of the conus 7. E.g. when detecting an increasing constant diameter part at the root of the conus 7 near nozzle outlet 3*a*, it may be assumed the fibre 8 formation process will be negatively impacted and requires an adjustment, e.g. by starting or adjusting a gas flow around the conus 7 via gas flow channel 3*b*.

In an even further embodiment, the vision feedback detection is used to detect the presence of multiple spin coni 7 out of nozzle outlet 3*a*. The presence of multiple spin coni 7, resulting in multiple fibres 8 being spun during operation, can be a desired or undesired mode of operation of the electrospinning apparatus, and the vision feedback can be used to detect or even stabilize such mode of operation.

The measurement data derived from the captured images may also be used for quality control or even certification purposes of a product manufactured by the electrospinning apparatus. To this end, a further method embodiment comprises storing measurement data.

In a further aspect the present invention relates to an electrospinning apparatus comprising a (fluid) spinning material supply unit 6; a nozzle unit 3 in communication with the spinning material supply unit 6 having a nozzle outlet 3*a*; a collector unit 1 for collecting a fibre 8 formed during operation of the electrospinning apparatus; a voltage supply unit 2 for applying a voltage difference between the nozzle unit 3 and collector unit 1; an imaging device 4 for capturing an image of a conus 7 and the fibre 8 being formed during operation; and a processing unit 5 connected to the imaging device 4, spinning material supply unit 6 and voltage supply unit 2, wherein the processing unit 5 is arranged to determine a shape of the conus 7, and control operation of the electrospinning apparatus based on the determined shape of the conus 7. In a further embodiment, the processing unit 5 is arranged to execute the method according to any one of the method embodiments described herein.

The advantage of this electrospinning apparatus is the gain in process reproducibility. In case of e.g. creating medical implants by electrospinning, all variations in mesh and fibre morphology are a huge problem for product performance and certification, which can be addressed by the present invention embodiments. The present invention embodiments enable a new level of control on the spinning conus 7 which provides better reproducibility of the process resulting in better quality medical implants and much less scrap of materials (ranging from spun meshes to complete implants).

In an even further embodiment, the electrospinning apparatus further comprises an environment control unit connected to the processing unit 5 for controlling environmental conditions in a processing chamber of the electrospinning apparatus. Environmental control of the actual spinning (fibre forming) space is relevant, but the present invention embodiments also allow a feedback based control with a constant monitoring and adjustment of process parameters when needed.

As shown in the embodiment of FIG. 2, the nozzle unit 3 may further comprise a gas flow channel 3*b* surrounding the nozzle outlet 3*a*. The electrospinning apparatus then further comprises a gas flow control unit connected to the processing unit 5 for controlling an amount of gas flowing through the gas flow channel 3*b*. Additionally or alternatively, the electrospinning apparatus further comprises a nozzle position control unit connected to the processing unit 5 for controlling a nozzle protrusion distance $W_N$ of the nozzle outlet 3*a* extending into a processing chamber of electrospinning apparatus. This allows direct influence on the spinning process distance (from nozzle unit 3 to collector unit 1) but also allows to fine tune electrical parameters, i.e. the field strength and field strength distribution between nozzle unit 3 and collector unit 1.

In an even further exemplary embodiment, the nozzle outlet 3*a* comprises a mixture of multiple fluid flows, e.g. in a coaxial or side-by-side configuration. Vision feedback as described above with reference to other embodiments may be used to control the mixing ratio of each of the individual material flows.

In a further embodiment, the vision feedback can also be used to control the protrusion distance or relative distance between material flow outlets to control the fiber morphology.

The electrospinning apparatus may in a further embodiment comprise an injector positioned in the nozzle unit 3, which is connected to the processing unit 5 for control of the injector operation. The injector may be applied in a pulse like manner to control material flow of the nozzle outlet 3*a*, e.g. based on vision feedback using the imaging device 4.

The present invention has been described above with reference to a number of exemplary embodiments as shown in the drawings. Modifications and alternative implementations of some parts or elements are possible and are included in the scope of protection as defined in the appended claims.

The invention claimed is:

1. A method for electrospinning of material by ejecting spinning material from a nozzle outlet of an electrospinning apparatus, the nozzle outlet having an outer diameter, the method comprising determining a shape of a conus of fluid spinning material exiting the nozzle outlet from an image captured during operational use of the electrospinning apparatus, wherein determining a shape of the conus comprises a calibration of the captured image using predetermined dimensions of a reference part of the electrospinning apparatus and edge detection in the captured image, determining from the shape of the conus a spin wire diameter determination area in the captured image, detecting an actual spin wire diameter at the spin wire diameter determination area, and controlling operating parameters of the electrospinning apparatus based on a difference between the actual spin wire diameter and a desired spin wire diameter.

2. The method according to claim 1, wherein the operating parameters of the electrospinning apparatus comprise one or more of:

a voltage between the nozzle outlet and a collector unit;

an amount of spinning material flowing through the nozzle outlet;

environmental conditions in a processing chamber of the electrospinning apparatus;

an amount of gas flowing through a gas flow channel surrounding the nozzle outlet; and a nozzle protrusion distance of the nozzle outlet extending into a processing chamber of electrospinning apparatus.

3. The method according to claim 1, further comprising adjusting the operating parameters of the electrospinning apparatus upon detection of a change of the shape of the conus.

4. The method according to claim 1, further comprising storing measurement data.

5. The method according to claim 1, wherein the step of detecting the actual spin wire diameter at the spin wire diameter determination area comprises determining the actual spin wire diameter at the spin wire diameter determination area using edge detection.

6. The method according to claim 1, wherein determining a shape of a conus comprises determining a base point along a primary axis of the electro spinning apparatus.

7. The method according to claim 6, wherein the base point is determined using curve matching of an edge of the conus in the captured image.

8. The method according to claim 6, wherein the spin wire diameter determination area is determined as a point along the primary axis at a predetermined distance from the base point.

9. The method according to claim 6, wherein the spin wire diameter determination area is determined as a point along the primary axis at a predetermined factor times the base point distance from an edge of the nozzle outlet in the captured image to the base point.

10. The method according to claim 6, wherein the base point is measured periodically over time.

11. The method according to claim 6, wherein the primary axis comprises a primary axis of the nozzle outlet of the electrospinning apparatus, a centreline of the spinning conus, or a trajectory of the spinning material of a fibre being formed.

12. An electrospinning apparatus comprising:

a spinning material supply unit;

a nozzle unit in communication with the spinning material supply unit having a nozzle outlet;

a collector unit for collecting a fibre formed during operation of the electrospinning apparatus;

a voltage supply unit for applying a voltage difference between the nozzle unit and collector unit;

an imaging device for capturing an image of a conus of fluid spinning material and the fibre being formed during operation; and a processing unit connected to the imaging device, spinning material supply unit and voltage supply unit, wherein the processing unit is arranged to determine a shape of the conus by a calibration of the captured image using predetermined dimensions of a reference part of the electrospinning apparatus and edge detection in the captured image, determine from the shape of the conus a spin wire diameter determination area in the captured image, an actual spin wire diameter at the spin wire diameter determination area, and control operating parameters of the electrospinning apparatus based on a difference between the actual spin wire diameter and a desired spin wire diameter.

13. The electrospinning apparatus according to claim 12, wherein the processing unit is arranged to execute the method according to claim 1.

14. The electrospinning apparatus according to claim 12, wherein the electrospinning apparatus further comprises an environment control unit connected to the processing unit for controlling environmental conditions in a processing chamber of the electrospinning apparatus.

15. The electrospinning apparatus according to claim 12, wherein the nozzle unit further comprises a gas flow channel surrounding the nozzle outlet, and the electrospinning apparatus further comprises a gas flow control unit connected to the processing unit for controlling an amount of gas flowing through the gas flow channel.

16. The electrospinning apparatus according to claim 12, wherein the electrospinning apparatus further comprises a nozzle position control unit connected to the processing unit for controlling a nozzle protrusion distance of the nozzle outlet extending into a processing chamber of the electrospinning apparatus.

17. The electrospinning apparatus according to claim 12, wherein the processing unit is arranged to detect said actual spin wire diameter at the spin wire diameter determination area using edge detection.

* * * * *